United States Patent [19]

Arnhold et al.

[11] 4,137,746

[45] Feb. 6, 1979

[54] BENDING MATRIX AND LINER

[75] Inventors: Franz Arnhold, Ottenbach; Walter Husner, Affoltern am Albis, both of Switzerland

[73] Assignee: Ernst Schweizer AG, Metallbau Zürich, Zürich, Switzerland

[21] Appl. No.: 841,355

[22] Filed: Oct. 12, 1977

[30] Foreign Application Priority Data

Oct. 13, 1976 [CH] Switzerland ..... 12971/76

[51] Int. Cl.[2] ..... B21D 5/01

[52] U.S. Cl. ..... 72/389

[58] Field of Search ..... 72/389, 385, 386, 396, 72/465, 470

[56] References Cited

U.S. PATENT DOCUMENTS

| | | | |
|---|---|---|---|
| 3,302,439 | 2/1967 | Chattin | 72/389 |
| 3,914,972 | 10/1975 | Gillette | 72/386 |

FOREIGN PATENT DOCUMENTS

| | | | |
|---|---|---|---|
| 16443 of | 1915 | United Kingdom | 72/344 |

*Primary Examiner*—C. W. Lanham
*Assistant Examiner*—Gene P. Crosby
*Attorney, Agent, or Firm*—J. Harold Nissen

[57] ABSTRACT

A bending matrix, and in particular a folding matrix of a die bending tool. The inlet edges of the matrix opening are provided with a liner formed from an anti-friction material with a low coefficient of friction, and the base of the matrix opening is formed of a material capable of and intended to absorb the ram pressure.

8 Claims, 1 Drawing Figure

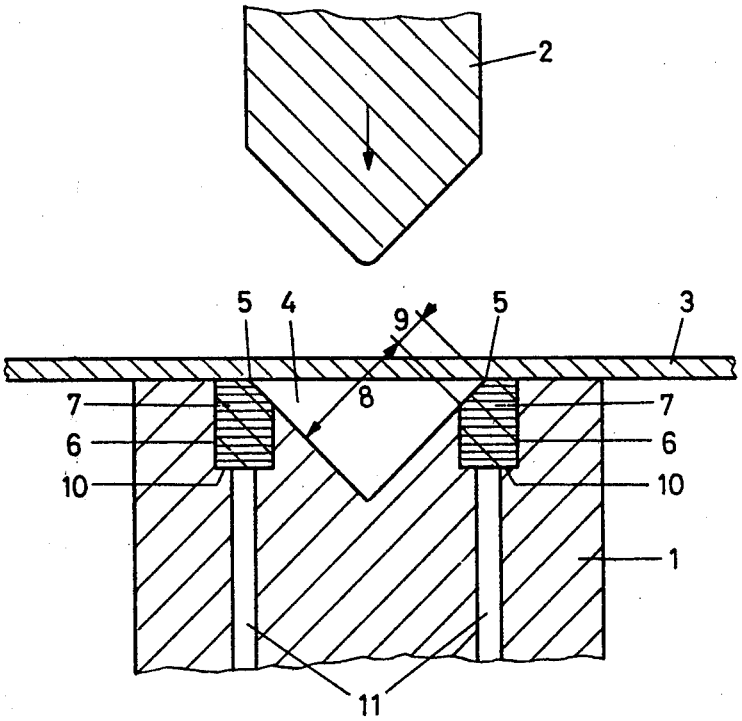
2
5
4
9
5
3
7
8
7
6
6
10
10
1
11

BENDING MATRIX AND LINER

BACKGROUND OF THE INVENTION

This invention relates to a bending matrix for die bending sheet metal on folding presses. More particularly, the invention is concerned with a matrix having a profiled opening provided with a liner covering the profiled opening.

In the die bending of sheet metal on folding presses, the sheet metal is inserted between a ram and the matrix and is profiled by cold working. The ram acts as a die tool. When cold working various metals, the surface of such metals are marred. This is particularly so in the case of sheets of light metal, nonferrous metal, chromium steel, and surface-finished metal sheets (anodized, varnished, plastic-coated, plated, electroplated, hot-galvanized, etc.), because undesired friction points, scratches, or grooves occur during the bending process. Such markings must subsequently be removed, for example, by grinding or polishing.

To prevent such undesired markings, it is known to insert sheets of fabric or rubber between the sheet metal and the matrix. Foil-coated metal sheets can also be used. When such foils are used, they have to be removed after the stamping process. However, these extra steps in the processes are relatively expensive and labor-consuming.

It has therefore been proposed to use a single-piece plastic or steel matrices with a plastic insert completely surrounding the matrix opening. However, matrices of this type have not proved acceptable, since the plastic was excessively deformed by the high ram pressure. Such excessive ram pressure usually lead to inaccurate longitudinal profiles.

Since the injuries and damages to the sheet metal occur primarily at the inlet edges of the matrix opening, attempts have heretofore been made to prevent the injuries to the sheet metal by polishing these edges. However, it was found that scratches appeared again after only a few stampings, so that the polishing operation had to be repeated regularly. This repeated polishing naturally greatly hindered a rapid sequence of operations.

It is therefore an object of the invention to provide a bending matrix in which the afore-mentioned disadvantages are avoided.

Another object of the invention is to provide a folding matrix which makes use of a die bending tool in which the material to be profiled is free of undesired markings.

SUMMARY OF THE INVENTION

In order to accomplish the foregoing objects, the invention proposes the use of a liner which consists of an anti-friction material having a low coefficient of friction.

According to the invention, the inlet edges of the matrix opening consist of an anti-friction material with a low coefficient of friction, and the base of the matrix opening consists of another material intended for and capable of accepting the ram pressure.

In contrast to the previously known materials such as hard rubber, bronze, leather, and fibrous material/plastic mixtures, which build up on the workpiece, this anti-friction material suitably has the property of not building up on the workpiece, as a result of its composition and the low coefficient of friction.

BRIEF DESCRIPTION OF THE DRAWING

The single FIGURE of the drawing illustrates a vertical section taken through a folding tool comprising a ram and a bending matrix, illustrating the placement of the liner at the inlet edges of the bending matrix.

DETAILED DESCRIPTION OF THE DRAWING

The folding tool as shown in the single FIGURE of the drawing is used for the production of long profile sections and consists, in a known manner, of a steel matrix 1 and a ram 2. A metal sheet 3 is placed onto matrix 1. When the ram 2 is lowered, the metal sheet 3 which is shown positioned on the matrix 1 is pressured into the matrix opening 4 and is thereby profiled.

During the bending process, cold working of the metal sheet 3 takes place. The metal sheet 3 flows around the inlet edges 5 of the matrix 1. In this way, the previously mentioned damage to the sheet metal surface is produced when the heretofore known matrices are used.

In the present matrix according to the invention, longitudinal grooves 6 are recessed in the region of the inlet edges 5. Profiled inserts 7 are provided and they are pressed into the inlet edges 5. The profiled inserts 7 correspond to and are profiled in accordance with the profile of the inlet edges 5. The profiled inserts 7 are made of an anti-friction material with good wear and anti-friction properties and cause no build-up.

Experiments have shown that, by means of this design of the matrix, damage to the sheet metal surface during a folding or profiling operation can be prevented.

The profile form of the sheet metal is determined by the matrix opening 4, and, in order to achieve a high angular precision, the width of the supporting steel surface 8, as indicated by the large double arrowed line, must not be too small. In the present embodiment, the width of the anti-friction material area portion 9, as indicated by the small double arrowed line, and the width of the steel area portion 8 were selected in a ratio of 1:4 for the rectangular boundary surfaces of the matrix opening. The base 8 is formed of a material capable of and intended to absorb the ram pressure. Base 8 may be of the same material as matrix 1.

This ratio may vary in other matrices; however, it is appropriate in all cases to select the width of the anti-friction material area portion 9 smaller than the width of the base material area portion 8 which accepts the ram pressure.

In order to be able to replace the anti-friction inserts 7, the matrix 1 has a number of holes 11 opening into the groove bottoms 10. Ejection pins (not shown) can be introduced through holes 11 to remove the anti-friction inserts 7 by ejecting them through the top of the matrix 1.

The length of the inlet edges equipped with the anti-friction material and the inclination or value of the matrix opening angle are to be adapted to the desired profile.

It is also readily possible to mill or plane grooves into already existing matrices and to equip these grooves with appropriate anti-friction inserts according to the invention.

Other bending matrices, for example, those of deep-drawing tools, and other functionally analogous anti-friction points of non-cutting shaping tools can be designed in the manner described.

While there has been shown what is considered to be the preferred embodiment of the invention, it will be obvious to those skilled in the art that various changes and modifications may be made therein without departing from the scope of the invention.

We claim:

1. In a bending matrix for the die bending of sheet metal on folding presses, said matrix having a profiled opening, inlet edges to said opening and a base at the bottom of said opening, the improvement comprising:

two longtitudinal grooves in the region of said inlet edges;

a liner consisting of an anti-friction material with a low coefficient of friction, said liner being formed as inserts and being supported in said grooves to form said profiled opening;

openings opening into said longitudinal grooves to permit the insertion of ejection pins into said longitudinal grooves to remove said anti-friction inserts; and another material capable of absorbing ram pressure for said base.

2. The matrix according to claim 1, wherein the boundary surfaces of said profiled opening and said base are made of steel, and the width of said anti-friction material area portion is smaller than the width of said steel area portion.

3. The matrix according to claim 1 wherein said base and said matrix are of the same material.

4. The matrix according to claim 1, wherein said base is formed of a hard material, and said profiled opening is formed of the same material as said base, and the ratio of the width of the base area portion to the width of said anti-friction material is 4:1.

5. The matrix according to claim 1, wherein the width of the anti-friction material is less than the width of said other material.

6. The matrix according to claim 5, wherein said base and said matrix are of the same material.

7. The matrix according to claim 5, wherein the ratio of the width of said other material area portion to the width of the area portion of said anti-friction material is 4:1.

8. The matrix according to claim 7, wherein said base and said matrix are of the same material.

* * * * *